United States Patent [19]

Fenton et al.

[11] Patent Number: 4,925,053

[45] Date of Patent: May 15, 1990

[54] FUEL TANK VAPORIZATION AND EXPLOSION RESISTANT APPARATUS AND IMPROVED FILLER MASS

[75] Inventors: Ronald L. Fenton, Wood Dale, Ill.; Robert Brandt, New York, N.Y.

[73] Assignee: Safetytech Corporation, Mount Prospect, Ill.

[21] Appl. No.: 330,354

[22] Filed: Mar. 28, 1989

[51] Int. Cl.[5] ..... B65D 25/02

[52] U.S. Cl. ..... 220/88 A; 206/0.6

[58] Field of Search ..... 206/0.6, 0.7; 220/88 A, 220/88 R, 3

[56] References Cited

U.S. PATENT DOCUMENTS

| | | | |
|---|---|---|---|
| 958,944 | 5/1910 | Steward | 220/88 A |
| 3,356,256 | 12/1967 | Szego | 220/88 R |
| 4,149,649 | 4/1979 | Szego | 220/88 A |
| 4,361,190 | 11/1982 | Szego | 220/88 A |
| 4,566,589 | 1/1986 | Poschinger | 206/0.6 |
| 4,673,098 | 6/1987 | Fenton et al. | 220/88 A |

*Primary Examiner*—Jimmy G. Foster

*Attorney, Agent, or Firm*—Douglas B. White

[57] ABSTRACT

Generally there is provided an expanded foil sheet having an array of openings in a pattern exhibiting a plurality of dimension, which sheets are rolled or stacked, such that juxtaposed openings differ in dimension, to form a thermal filler mass for a tank. Alternatively, two or more foil sheets, each exhibiting openings or a pattern of openings of dimension differing from the openings of adjacent sheets are combined in a roll or stack to form the filler mass. Finally, in a further feature, the filler mass is adhered to the tank wall.

6 Claims, 2 Drawing Sheets

FUEL TANK VAPORIZATION AND EXPLOSION RESISTANT APPARATUS AND IMPROVED FILLER MASS

BACKGROUND OF THE INVENTION

1. Field of the Invention

The present invention relates generally to tanks used for flammable or explosive fluids such as fuel tanks, including gasoline, diesel fuel, and LPG gas; and particularly this invention relates to tanks employing a filler mass insert to aid thermal distribution to suppress explosion or to boost vaporization.

2. Description of the Prior Art

In a typical tank application, such as a propane or LPG tank, there is generally encountered a metallic tank wall designed to contain the fuel under pressure, with associated valves and connections at one end to access the contents thereof. During normal operation of a vaporization system the liquid fuel vaporizes in the tank under ambient heat to provide an operating pressure under which the vapor is withdrawn through the tank valve. Consequently, the pressure of the system falls as a result of use and the tank will exhibit decreased function until the liquid temperature is raised.

Similarly, in liquid fuel applications, where heat is applied locally to the tank (such as in a fire), the liquid proximate the hot spot will boil and increase the vapor pressure within the tank and possibly ignite. Prior attempts to neutralize the explosion tendencies of the tank have included providing an expanded aluminum foil mesh as a filler mass insert within the tank.

Improvements in filler mass design have been directed to preventing nesting of the mesh by reversing alternate layers in a roll. Nesting occurs where the mesh pattern of adjacent layers settle against each other in a mating relation. This anti-nesting system is described in the 1979 patent issued to Szego, U.S. Pat. No. 4,149,649, as applied to explosion suppression in fuel tanks, although the technique had been employed for many years prior in the filter industry. This filter application has been the principal use of such expanded foil. Even with the anti-nesting technique of Szego, the foil mesh collapsed and compressed during use and its effectiveness diminished. Recently, U.S. Pat. No. 4,673,098, issued to Fenton et al., dramatically improved the thermal conductivity and reduced the compression tendency by using adhesive to secure the filler mass within the tank. Notwithstanding these developments the need continued to exist for the development of a filler mass and tank apparatus design which would be more economical to manufacture, allow for greater fuel volume, and provide greater thermal distribution.

SUMMARY OF THE INVENTION

It is accordingly a principal objective of the present invention to provide a tank apparatus with a filler mass insert which causes a minimal reduction in tank volume;

It is a further objective to provide a filler mass for a fuel tank which doesn't nest, yet is economical to manufacture; and It is finally an objective of the improved filler mass insert to provide increased thermal transfer through better interstitial flow.

Generally there is provided in a first embodiment an expanded foil sheet having slit formed openings of varying dimensions, which sheet is rolled or stacked to form a filler for a tank. In a second embodiment, two or more foil sheets are formed, with each sheet having an array of openings but differing from one sheet to the next in the dimensions of the openings. These sheets would be rolled or stacked and inserted as a filler mass for a tank. Finally, in a further feature, the insert is adhered to the tank wall by use of a thermally conductive adhesive.

While the invention will be described in connection with a preferred embodiment, it will be understood that we do not intend to limit the invention to that embodiment. On the contrary, we intend to cover all alternatives, modifications, and equivalents as may be included within the spirit and scope of the invention as defined by the appended claims.

DESCRIPTION OF THE PREFERRED EMBODIMENT

Figure 1:
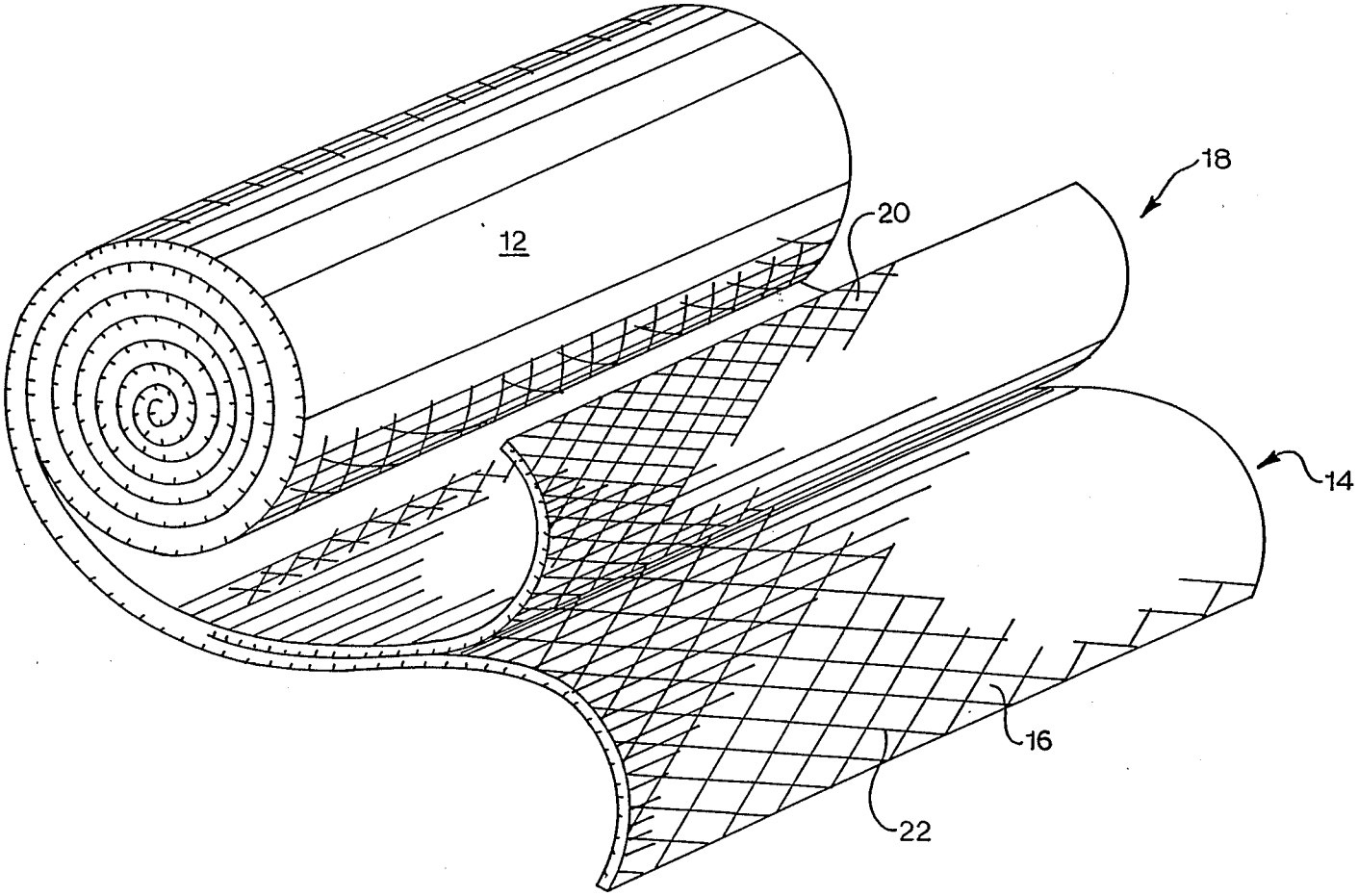
FIG. 1 is a perspective view of a roll of two sheets of thermally conductive foil, each sheet having an array of openings but differing between them in the dimensions of the openings.
Figure 3:
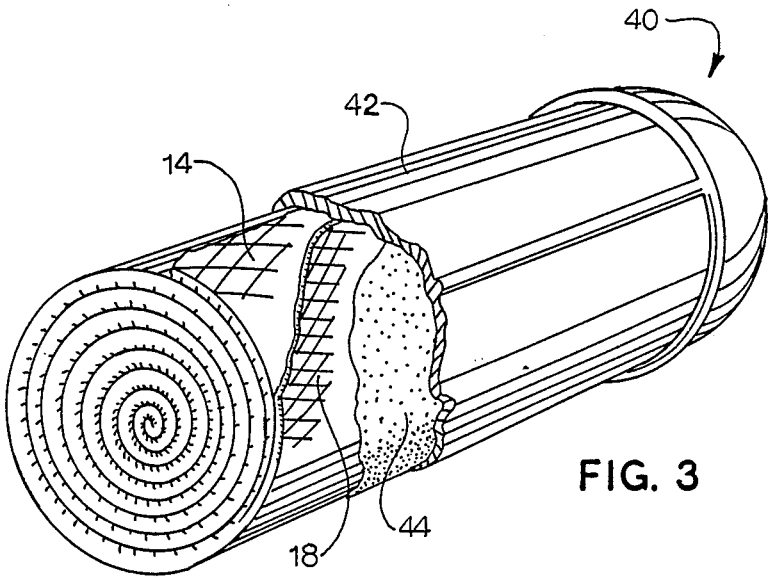
FIG. 3 is a perspective view of a tank apparatus employing the filler mass of FIG. 1.

Turning first to FIG. 1, there is shown the construction of a filler mass in accordance with the present invention for insertion within a tank as depicted in FIG. 3. This filler comprises a roll 12 of expanded foil mesh. The actual construction of this mesh is commonly known in the art and involves the placement of a plurality of slits in a sheet of thermally conductive foil, such as an aluminum foil, and the pulling of the sheet to expand the openings. In the manufacture of the sheet, an array of slits of predetermined dimension establish the dimension of the openings produced when the sheet is pulled and expanded.

Figure 2:
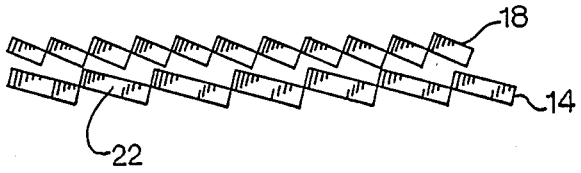
FIG. 2 is a cross sectional view of the paired sheets of FIG. 1 showing the relationship of the foil sheets and the raised periphery of the openings.
Figure 4:
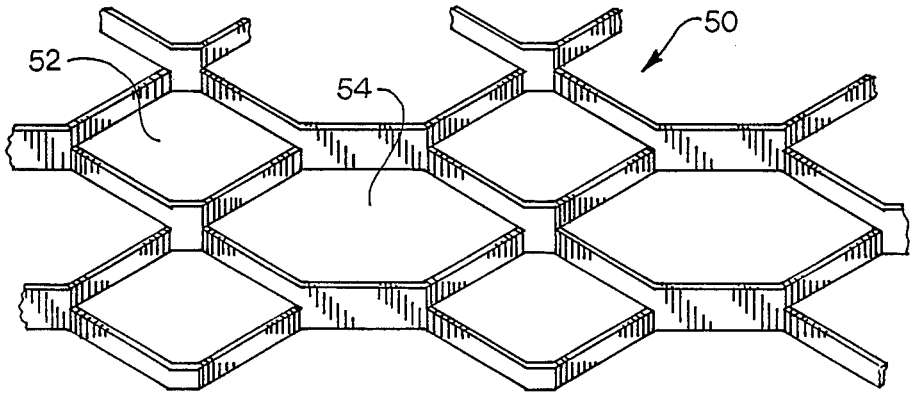
FIG. 4 is a perspective view of an alternative design of a single sheet of foil for use in the filler mass of the tank apparatus, said foil having an array of openings of various sizes thereon.

In the first embodiment, a first sheet 14 is provided with spaced slits and thereby specifically dimensioned openings 16 when expanded. A second sheet 18 is similarly provided with spaced slits and resulting dimensioned openings 20 when expanded. When the foil is expanded, a peripheral edge 22 results and projects transversly to the plane of the sheet. (see FIGS. 2 and 4 for example). In accordance with the present invention, the openings 16 in the first sheet are designed to be larger or of a different shape than the openings 20 of the second sheet. This results from the modification of the slit pattern when preparing the foil sheet. With this mismatch of dimension (size or shape), the second sheet 18 overlies the first sheet 14, as shown in FIG. 2 and, consequently, the sheets cannot nest into a mating relationship. As a result, the spacial separation of the two sheets is maintained when the sheets are combined into layers, yet the sheets do not need the further expensive processing of folding or reversing to accomplish the anti-nesting effect.

Once stacked or rolled, the filler mass is inserted into a container 40 (FIG. 4), such as a metal tank, having thermally conductive walls 42. The filler is adapted to conform to the container and is preferrably secured to the walls by adhesive 44. Satisfactory results have been obtained with an adhesive known as EC 776 manufactured by 3M Corporation. This adhesive promotes thermal conduction, prevents separation of the filler mass from the container and resists the corrosive action by the tank contents.

In yet a further embodiment, the filler mass is manufactured from a single sheet 50, with an array of openings having differing dimensions arranged across the sheet. When the slits in the foil are arranged to generate regular diamond shaped openings as depicted, this provides a pattern of small and large sized openings 52 and 54, respectively, and provides a corresponding pattern of projecting periphery. When coiled or stacked with other sheets, the relationship between adjacent layers is adjusted to juxtapose the differing dimensioned openings to avoid nesting.

With both embodiments due to the enlarged opening size in the combination, thermal convection through the filler is increased with a resulting improvement in the efficiency of the apparatus. Moreover, the enlarged openings increase the available fuel volume and reduce the cost of materials and costs of manufacturing of the filler mass insert.

From the foregoing description, it will be apparent that modifications can be made to the apparatus and method for using same without departing from the teaching of the present invention. Accordingly the scope of the invention is only to be limited as necessitated by the accompanying claims.

We claim:

1. A thermally conductive filler mass insert for a container comprising multiple layers of thermally conductive sheet, each of said layers having a plurality of slit formed openings defined therein, the periphery of said openings forming edges projecting transversely to the plane of said layer wherein said insert comprises a stack of interleaved layers, wherein each of said layers exhibits an array of a plurality of openings in a pattern exhibiting a plurality of dimensions, said layers being arranged to juxtapose openings of differing dimension.

2. A thermally conductive filler mass insert for a container comprising multiple layers of thermally conductive sheet, each of said layers having a plurality of slit formed openings defined therein, the periphery of said openings forming edges projecting transversely to the plane of said layer wherein said insert comprises a roll of a single sheet, said roll producing multiple layers of said sheet, wherein each of said layers exhibits an array of a plurality of openings in a pattern exhibiting a plurality of dimensions, and wherein said layers are arranged to juxtapose openings of differing dimensions.

3. A container of thermally responsive fluids comprising a thermally conductive container wall, a thermally conductive filler mass inert within said walls and in thermal contact therewith, said insert comprising multiple layers of thermally conductive sheet having slit formed openings therein, the periphery of said openings being arranged to project transversely to the plane of said sheet wherein each of said layers exhibits an array of a plurality of openings in a pattern exhibiting a plurality of dimensions, wherein said insert comprises a stack of interleaved layers, and wherein said layers are arranged to juxtapose openings of differing dimensions.

4. The container of claim 3 further comprising adhesive means for adhering said insert to said container wall.

5. A container of thermally responsive fluids comprising a thermally conductive container wall, a thermally conductive filler mass insert within said walls and in thermal contact therewith, said insert comprising multiple layers of thermally conductive sheet having slit formed openings therein, the periphery of said openings being arranged to project transversely to the plane of said sheet wherein said insert comprises a roll of a single sheet, said roll producing multiple layers of said sheet, wherein each of said layers exhibits an array of a plurality of openings in a pattern exhibiting a plurality of dimensions, and wherein said layers are arranged to juxtapose openings of differing dimension.

6. The container of claim 5 further comprising adhesive means for adhering said insert to said container wall.

* * * * *